US006886467B1

(12) United States Patent
Haeselich

(10) Patent No.: US 6,886,467 B1
(45) Date of Patent: May 3, 2005

(54) TRAINING CARTRIDGE FOR AN AUTOMATIC RAPID-FIRE WEAPON

(75) Inventor: Detlef Haeselich, Muessen (DE)

(73) Assignee: Nico-Pyrotechnik Hanns-Juergen Diederichs GmbH & Co. KG, Trittau (DE)

( * ) Notice: Subject to any disclaimer, the term of this patent is extended or adjusted under 35 U.S.C. 154(b) by 0 days.

(21) Appl. No.: 09/959,170

(22) PCT Filed: Apr. 19, 2000

(86) PCT No.: PCT/DE00/01281

§ 371 (c)(1),
(2), (4) Date: Jan. 28, 2002

(87) PCT Pub. No.: WO00/63635

PCT Pub. Date: Oct. 26, 2000

(30) Foreign Application Priority Data

Apr. 19, 1999 (DE) ..... 199 17 649

(51) Int. Cl.[7] ..... F42B 8/04; F41A 21/26
(52) U.S. Cl. ..... 102/444; 529/530; 89/14.5
(58) Field of Search ..... 102/444, 530, 102/531, 529; 89/14.5, 29, 30; 42/54, 55, 77

(56) References Cited

U.S. PATENT DOCUMENTS 1,804,986 A * 5/1931 Quayle et al. ..... 102/530
2,918,868 A * 12/1959 Ringdal ..... 102/530
3,935,816 A * 2/1976 Boquette, Jr. ..... 102/444
4,867,065 A * 9/1989 Kaltmann et al. ..... 102/444
4,958,567 A * 9/1990 Olson ..... 102/444
5,016,536 A * 5/1991 Brighton ..... 102/430
5,438,907 A * 8/1995 Reynolds et al. ..... 89/14.5
5,492,063 A * 2/1996 Dittrich ..... 102/430
6,095,051 A * 8/2000 Saxby ..... 102/444

FOREIGN PATENT DOCUMENTS

DE 1453827 5/1965
DE 3733216 4/1989
DE 4134505 4/1993
FR 1 448 834 A * 11/1966
FR 2 379 041 A * 8/1978
FR 2 394 779 A * 1/1979
GB 2 319 076 A * 5/1998

* cited by examiner

*Primary Examiner*—Michael J. Carone
*Assistant Examiner*—James S. Bergin
(74) *Attorney, Agent, or Firm*—Milde & Hoffberg, LLP

(57) ABSTRACT

The invention relates to a training cartridge for an automatic rapid-fire weapon. Said training cartridge (1) has a central channel (4) running therethrough which accommodates a propellant charge (6) in the rear area of the cartridge (1) and is closed at the rear by a detonator charge (7) for the propellant charge (6). The training cartridge and weapon barrel are configured in such a way that no live ammunition can be fired from said weapon barrel. The channel which is open at the cartridge tip is preferably used during the firing of the training cartridge to receive a mandrel (28) of a gas choke (22) which is mounted in the weapon barrel (21). The propulsion gases which escape through the opening (8) at the cartridge tip propel the training cartridge backwards towards the weapon bolt and expel said cartridge from said bolt of the rapid-fire weapon. The bolt is simultaneously primed for the next shot.

13 Claims, 4 Drawing Sheets

TRAINING CARTRIDGE FOR AN AUTOMATIC RAPID-FIRE WEAPON

BACKGROUND OF THE INVENTION

The invention relates to a medium-bore training cartridge for an automatic rapid-fire weapon and also a system based on such a training cartridge and a weapon barrel.

For training purposes, it is necessary to have at one's disposal training and maneuver ammunition, the features of which correspond to live ammunition, at least where rapid-fire weapons are concerned, so that all functions can run smoothly. It must not be necessary in this regard to make any essential modifications to the weapon. At the same time, the training cartridge and any necessary conversion kit for the weapon must be configured in such a way that live ammunition cannot inadvertently be fired whilst shooting with maneuver ammunition.

German Patent No. DE-A-14 53 827 proposes to equip the training cartridge with a bore hole, which is closed off above the propellant charge arranged in the rear area and if necessary in the area near the cartridge tip by a destructible cap. If the cover(s) is (are) correctly dimensioned, the cartridge, when fired, is followed by an initial shock dust, which is sufficient to guarantee a recoil of the barrel when the weapon bolt is reversed. The covers are subsequently destroyed by the propellant charge and leave the barrel before the cartridge, the speed of which is reduced due to the presence of the continuous bore hole.

This type of training cartridge however does not guarantee to prevent live ammunition being inadvertently fired.

German Patent No. DE-A-37 33 216 discloses a weapon barrel for automatic weapons for the purposes of firing training ammunition, particularly blank cartridges, whereby a limiting bush is secured near a cartridge bearing and the weapon bolt inside the barrel and a nozzle insert is secured as a gas choke near the muzzle in the front part of the barrel. This limiting bush must be configured so as to prevent a live cartridge being fully pushed into the barrel, which ensures that the weapon will remain fully operable in this case. Training ammunition, which is simply modified to be thinner near the cartridge tip can be inserted so far into the limiting bush that the cartridge is completely accommodated by the barrel.

When firing blank cartridges, this barrel, which is preferably a de-commissioned barrel that has been modified for use with live ammunition, is replaced by a barrel suitable for firing live ammunition. The use of a nozzle insert, which if necessary has an adjustable tuyere area, creates a gas pressure in the barrel that is both necessary and adequate for automatic weapon function when a training cartridge is fired. This gas pressure guarantees both the locking function and ejection of the cartridge. The blank cartridge does not leave the barrel, the bang, smoke and possibly the flash from the muzzle are simply simulated when the blank cartridge is loaded.

This system can be applied to small-bore training ammunition. It does however require structural modifications to the barrel and the training ammunition.

Moreover, it is extremely difficult to achieve the gas pressure required for medium-bore rapid-fire weapons with this system. With conventional 40 mm training cartridges, gas pressures able to release the weapon bolt, which weighs approximately 7 kg, must be provided.

German Patent No. DE-A1-41 34 505 discloses a small-bore cartridge for simulated firing using a laser beam, which has a bush with longitudinal bore hole, whereby the external form of the bush corresponds to that of a standard cartridge case containing a cartridge. Release of a weapon bolt is also not possible with this cartridge.

SUMMARY OF THE INVENTION

The object of the invention is to provide a training cartridge, particularly for large-bore rapid-fire weapons, which allows large gas pressures to be created in the barrel that can release even heavy weapon bolts. A further purpose of a system based on this type of training cartridge and its application as a weapon barrel is to create an automatic rapid fire weapon, which has a reliable function, is simply constructed, consists of few components and which is therefore cost-effective to produce.

This object, as well as other objects which will become apparent in the discussion that follows are achieved, in accordance with the present invention, by providing a medium-bore training cartridge, for medium-bore automatic rapid-fire weapon, comprising a continuous central channel having a rear area, the channel accommodating a propellant charge in the rear area and being closed at the rear by a detonator charge for the propellant charge. The training cartridge is open at the cartridge tip and has devices for allowing this cartridge, and not a live projectile cartridge, to be inserted into a barrel designed for training purposes.

Accordingly, the training cartridge has a continuous central channel, which contains a propellant charge in the rear area of the cartridge and which is sealed off at the rear by a detonator charge for the propellant charge. The channel is open at the cartridge tip. Training cartridge and barrel both have devices to prevent the insertion of a live cartridge. The open channel of the training cartridge is preferably used for this purpose. When the training cartridge is fully inserted into the barrel, the mandrel of an insert projects into the barrel in the open end of the channel, whereby this insert limits the vacant space before the nose of the cartridge. The insert can also be equipped with overflow channels.

The mandrel ensures that a live cartridge cannot be inserted instead of a training cartridge, since this is sealed at its tip to prevent it from completely leaving the barrel. The rapid-fire weapon would be operable in such a case.

After the detonator charge has ignited the propellant charge, e.g. using a strike pin, the propellant gas disperses vehemently towards the open end of the central channel in the training cartridge, whereby a high gas pressure is rapidly created in the relatively small space between propellant charge and mandrel tip. This pressure rapidly propels the cartridge backwards towards the weapon bolt which is then released.

The diameter of the insert mandrel is preferably smaller than the diameter clearance of the central channel in the cartridge, which creates a gap between channel and mandrel through which the propellant gas starts to escape shortly after the propellant charge is ignited and through which the overflow channel in the insert acting as a gas choke runs towards the muzzle of the barrel. Given correct dimensions of the mandrel, central channel and gas choke, the same effects as those achieved with a live projectile cartridge can be simulated, e.g. flash, bang and smoke.

The training cartridge can essentially be constructed from four components, namely a cartridge base, a central barrel inserted into the cartridge base that runs longitudinal to the cartridge into which the propellant charge is loaded, an igniter cap inserted into the cartridge base for igniting the propellant charge and a single-piece cartridge body, which surrounds the central barrel from cartridge barrel upwards, but it does however leave the central barrel open at the cartridge tip. The cartridge body is preferably produced from injection-molded plastic. The cartridge base is usually a metal component and should preferably be aluminum or steel; the central pipe should preferably be steel, in order to be able to withstand the gas pressures occurring when the propellant charge is ignited.

It is also possible, to cover the nose end of the propellant charge with a destructible cap or rupture disk and/or provide a further nozzle or nozzle arrangement in the central channel, whereby the development of the gas pressure created in the barrel can be further optimized after the propellant charge has been ignited.

A training cartridge as proposed by the invention does not cause a direct pressure build up behind the training cartridge with simulated firing. Instead, the gases created by the propellant charge are fed into the cartridge over the cartridge tip, so that the gas pressure created between the cartridge tip and the insert in the barrel propels the training cartridge to release the weapon bolt.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
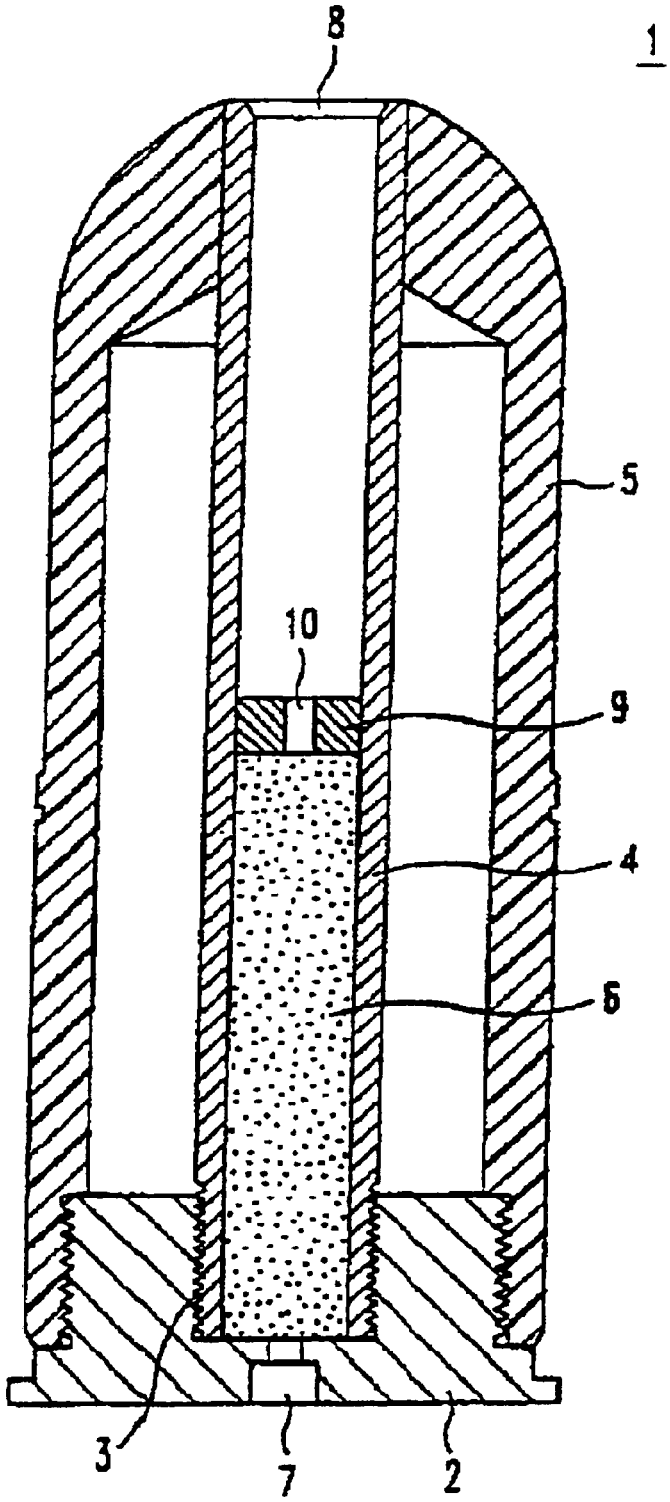
FIG. 1 is a cross-sectional view of a training cartridge for a 40 mm rapid-fire weapon as proposed by the invention.

As shown by FIG. 1, training cartridge 1 has a cartridge base 2 of aluminum, a central steel barrel 4 screwed into a central thread 3 of the cartridge base and a cartridge body 5 forming a cup shape from the cartridge base upwards, this cartridge body being a single-piece injection-molded plastic component and extending to the front end of the steel barrel 4. The rear half of the steel barrel 4 is filled with propellant charge 6, which, with the aid of a striking pin, can be ignited by an igniter cap 7 inserted into the cartridge base in the rear of the cartridge. The steel barrel has at its tip a free opening 8, the edge of which lies directly adjacent to the aforementioned cartridge body 5.

As shown in FIG. 1, central steel barrel 4 can be split at its center by a dividing wall 9, in which a nozzle 10 is provided, which connects the space around propellant charge 6 with the empty space in the steel barrel up to opening 8.

Figure 2:
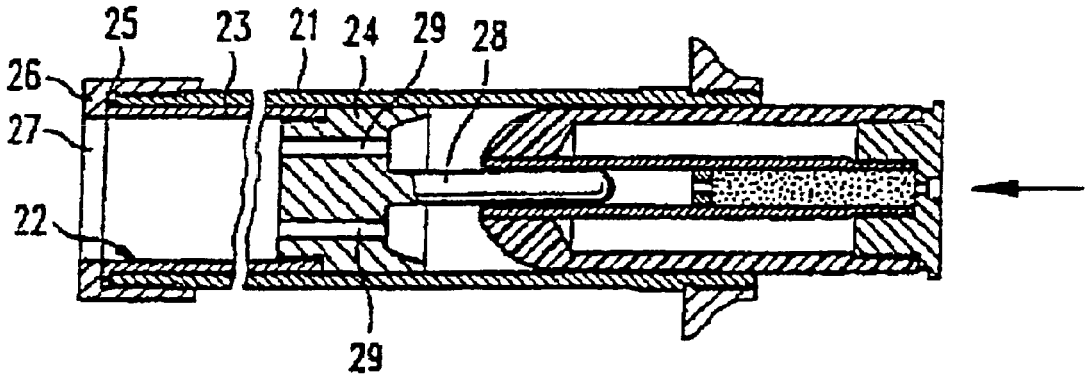
FIGS. 2 to 6 are sequential drawings showing the simulated firing of a training cartridge, from loading the cartridge through to ejection.

FIG. 2 shows a barrel 21 of an automatic rapid-fire weapon. An insert 22 is pushed into this barrel from the front end outwards, whereby this insert consists of a barrel 23 and a piston 24. Barrel 23 lies flush with the inside of barrel 21 and is fitted at the end facing piston 24 with a limit stop 25, which lies adjacent to the front edge of barrel 21. Barrel 23 is held by a spigot nut 26 with a central opening 27, which is screwed into an outer thread of the barrel 21.

Piston 24 has a central mandrel 28, the outer diameter of which is smaller than the clear diameter of steel barrel 4. The length of the mandrel is equivalent to a maximum of the distance between opening 8 of the steel barrel 4 and the dividing wall 9 in barrel 4.

Several further overflow channels 29 are provided around central mandrel 28 in the piston 24.

FIGS. 2 to 7 show the functional sequence of the automatic rapid-fire weapon when used with the training cartridge.

FIG. 2 shows the point in time at which training cartridge 1 is loaded by the bolt in barrel 21: this process causes central mandrel 28 of insert 22 to project into central steel barrel 4.

Figure 3:
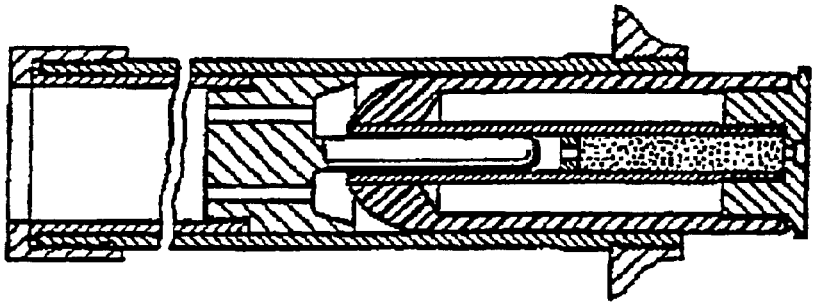

In FIG. 3, training cartridge 1 has completely left the lock and is located in barrel 21; at this moment in time, igniter cap 7 is ignited by a strike pin of the lock. The propellant charge 6 is ignited at virtually the same time.

Figure 4:
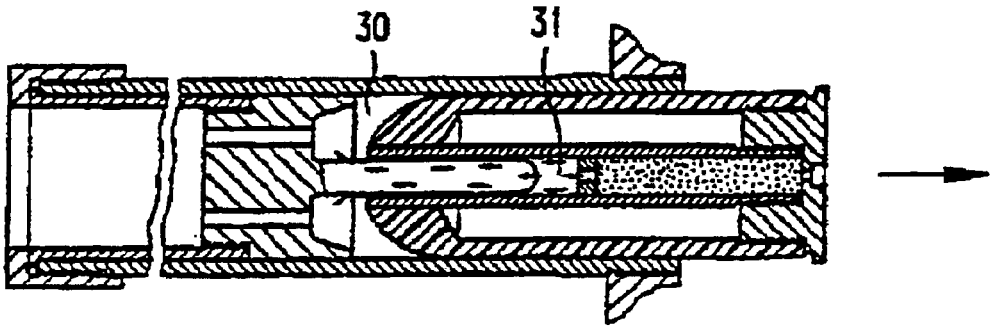

The propellant gases 31 generated as the charge is combusted, which are schematically illustrated in FIG. 4, disperse towards the cartridge nose, whereby the gas is choked through the gap between central mandrel 28 and the width clearance of central barrel 4. The gases flow into the space that forms a vacant space 30 between the front end of a propellant charge and the tip of the mandrel. This creates a high gas pressure, which, as indicated in FIG. 4 by the arrow, moves the cartridge back towards the lock.

Figure 5:
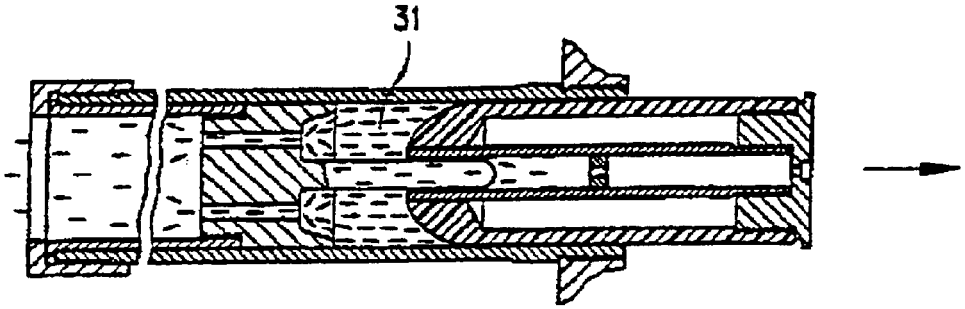

The propellant gases, the volume of which has increased in vacant space 30 between the cartridge nose and piston 24, escape from free opening 8 of the steel barrel and through the gap between mandrel 28 and steel barrel 4, so that the pressure of these propellant gases, as indicated in FIG. 5, now acts on the full face of the cartridge and accelerates this backwards into the cartridge. The propellant gases then flow through overflow channels 29 and escape into the outside air from central opening 27 of spigot nut 26.

Figure 6:
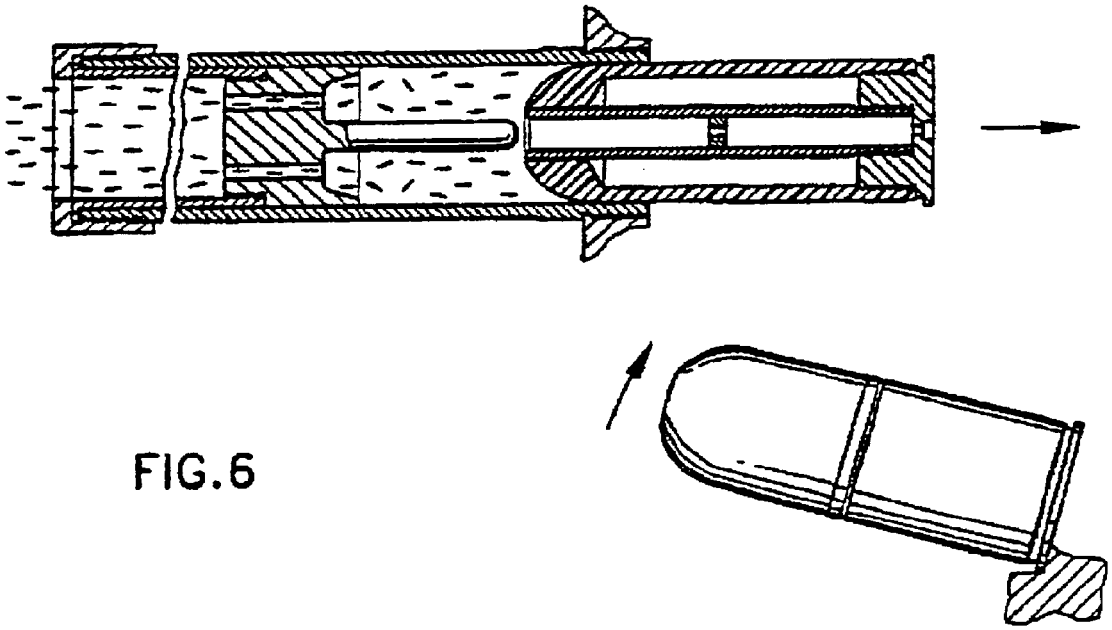

At the point in time indicated in FIG. 6, the training cartridge slides completely from central mandrel 28 and is transferred back into the bolt, from which point it is subsequently ejected.

By optimizing the dimensions of mandrel diameter 28, diameter clearance of steel barrel 4, number and diameter of overflow channels 29 and the distance between piston 24 and insert 22 and where necessary arranging and dimensioning nozzle 10 in dividing wall 9, the pressure build-up in barrel 21 can be optimized to force the training cartridge back into the bolt. The gas pressure created initially in a small high pressure space between propellant charge and mandrel tip and the subsequent creation of another pressure area between the piston and the entire cross-sectional area of the cartridge, the high forces required for the bolt of the automatic weapon to function are achieved. It is also possible, through the stated dimensioning and also of course collecting the propellant charge at the muzzle of barrel 21 for simulated firing, to imitate the effects occurring with live ammunition, e.g. flashes, bangs and smoke.

Figure 7:
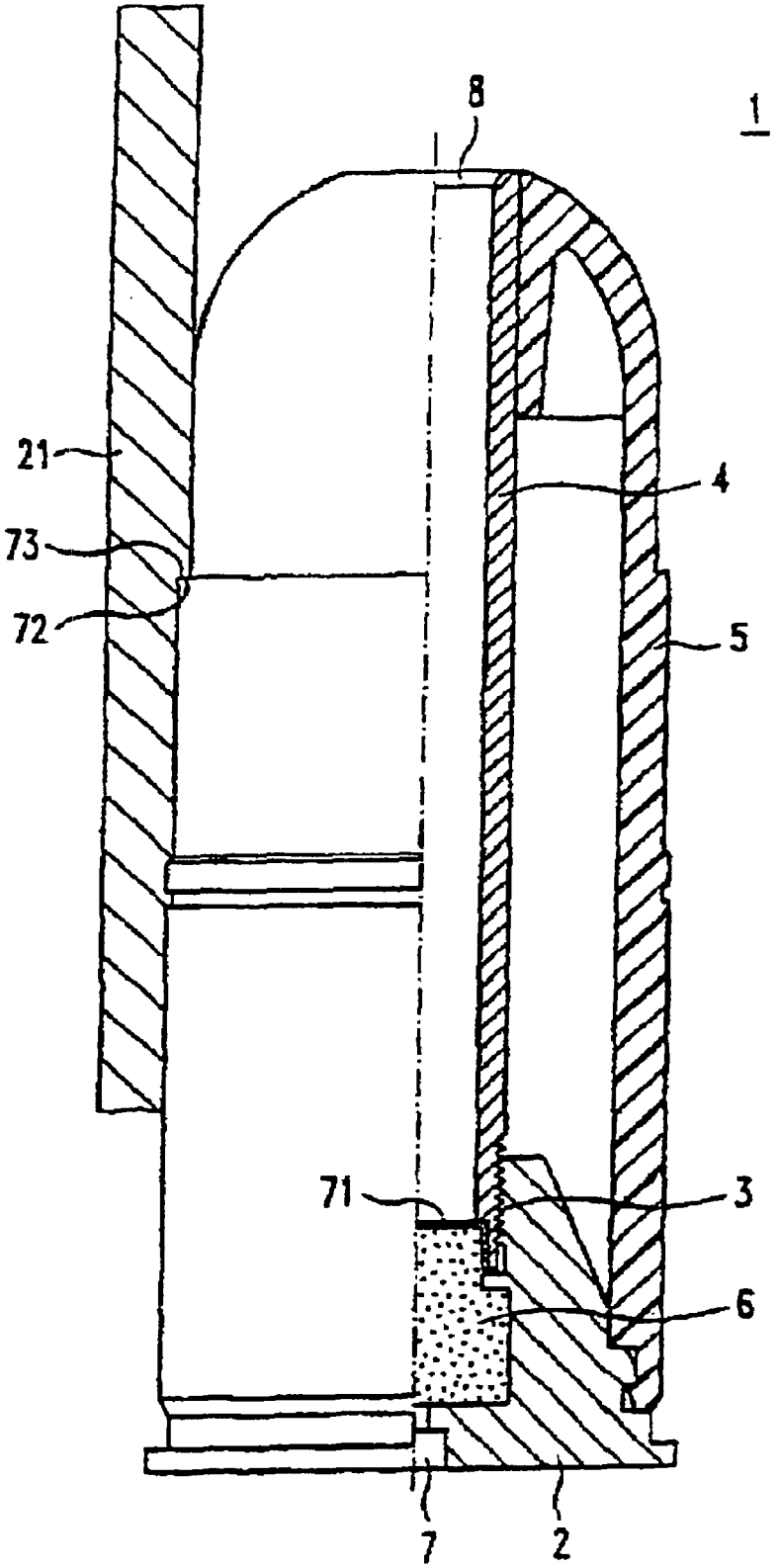
FIG. 7 is a partially cutaway view of a slightly modified training cartridge according to the invention.

FIG. 7 shows a modified training cartridge. For equivalent elements as illustrated by the design example in FIG. 1, equivalent reference symbols are used. With this cartridge, propellant charge 6 positioned on the rear side is covered by a destructible cap or rupture disk 71; the dividing wall with nozzle is omitted. The diameter of the training shot reduces in the nose area, so that a limit stop 72 is created, which then lies adjacent to a corresponding limit stop 73 of the barrel 21 indicated schematically here. In this nose area of the cartridge, the diameter of the barrel is smaller than in the rear area of the cartridge. Live ammunition, the diameter of which is the same in both the nose and the rear area, cannot be inserted into this barrel.

The firing functions are the same as described above; the mandrel, which in the above design is inserted into channel 8, is not required with this design. However, it is possible to use both mandrel and limit stop jointly. It is also possible, to provide a proprietary training barrel rather than modifying a barrel intended for live ammunition by adding an insert. If flashes, smokes and bangs are not simulated, the aforementioned overflow channels in the gas choke can also be omitted, so that all the gas pressure is used to drive back the cartridge and release the weapon bolt.

There has thus been shown and described a novel training cartridge for an automatic rapid-fire weapon which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Medium-bore training cartridge for a medium-bore automatic rapid-fire weapon, said cartridge having a continuous central channel in a longitudinal direction of the cartridge having a forward region with an open front tip end and a rear region with a closed rear end, said channel accommodating a propellant charge and being closed at the rear end by a detonator charge for the propellant charge, said cartridge comprising, in combination:

(a) a cartridge base;

(b) a central barrel inserted into the base and forming the central channel with the cartridge base at the rear end;

(c) an igniter cap inserted into the cartridge base for igniting the propellant charge; and (d) a single-piece cartridge body, which surrounds the central barrel from the cartridge base to the front tip end and which leaves the opening at the tip end.

2. Training cartridge in accordance with claim 1, wherein the cartridge body is an injection-molded plastic component.

3. Training cartridge in accordance with claim 1, wherein the cartridge base is a component made of a metal selected from the group consisting of aluminum and steel.

4. Training cartridge in accordance with claim 1, wherein the central barrel is made of steel.

5. Training cartridge in accordance with claim 1, wherein the central barrel has at least one of a gas choke and gas nozzle between the propellant charge and said open tip end.

6. Training cartridge in accordance with claim 1, wherein the propellant charge is covered within the central barrel by a destructible cap.

7. Training cartridge in accordance with claim 1, wherein the training cartridge has a smaller diameter in its forward region than in its rear region, whereby the two regions form a limit stop.

8. System based on a training cartridge, which can be fired from an automatic rapid-fire weapon having a barrels which is geometrically designed such that live ammunition cannot be inserted into the barrel, said weapon being constructed such that after the training cartridge is ignited, pressure is created in the barrel, which guarantees the automatic function of the weapon as if firing live ammunition, the improvement comprising the training cartridge recited in claim 1, wherein said training cartridge and said barrel have corresponding means permitting only the training cartridge, and not live ammunition, to be inserted into the barrel; wherein the barrel includes an insert which essentially fills its entire cross-sectional area and which, when the training cartridge is inserted, provides a vacant space in front of the forward region of the cartridge into which the gases created by the propellant charge flow from the open tip end of the central channel; and wherein the pressure created in the vacant space pushes the training cartridge backwards towards a weapon bolt and out of the barrel, whereby the weapon bolt is re-tensioned.

9. System in accordance with claim 8, wherein the insert includes a piston facing the training cartridge, which is fitted with a central mandrel and which projects into central channel of training cartridge inserted into the weapon.

10. System in accordance with claim 9, wherein a gas choke is provided in the piston.

11. System in accordance with claim 9, wherein the diameter of the central mandrel of the insert is smaller than the diameter clearance of the central channel of the training cartridge.

12. System in accordance with claim 9, wherein the piston is arranged at one end of a tube to be inserted flush into the weapon barrel, whereby the tube has a flange-type limit stop facing outwards at an end opposite the piston and wherein a spigot nut with a central opening is provided to secure and hold the insert in position in the weapon barrel.

13. System in accordance with claim 8, wherein the training cartridge has a corresponding limit stop in its nose area and the weapon barrel has a corresponding limit stop.

* * * * *